US005733605A

United States Patent [19]

Akiyama et al.

[11] Patent Number: 5,733,605

[45] Date of Patent: Mar. 31, 1998

[54] METHOD FOR FORMATION OF TWO-LAYER COATING FILM BY APPLICATION OF TWO COATINGS IN STATE OF TWO LAYERS CONTACTED WITH EACH OTHER

[75] Inventors: Tatsuru Akiyama, Kawanishi; Osamu Kozima, Amagasaki; Toshihide Fujitani; Yoshinori Hara, both of Hiratsuka, all of Japan

[73] Assignee: Kansai Paint Co., Ltd., Amagasaki, Japan

[21] Appl. No.: 774,295

[22] Filed: Dec. 24, 1996

[30] Foreign Application Priority Data

Dec. 27, 1995 [JP] Japan ..... 7-340490

[51] Int. Cl.[6] ..... B05D 1/34

[52] U.S. Cl. ..... 427/356; 427/402; 118/411

[58] Field of Search ..... 427/356, 402; 118/411

[56] References Cited

FOREIGN PATENT DOCUMENTS 4-100570 4/1992 Japan .

*Primary Examiner*—Katherine A. Bareford

*Attorney, Agent, or Firm*—Wenderoth, Lind & Ponack

[57] ABSTRACT

A method for forming a two-layer coating film by applying under specified conditions, onto a material to be coated, two coatings in a state of two layers contacting each other, by the use of a die capable of discharging two coatings in a state of two layers contacting each other and then conducting baking, wherein a cured two-layer coating film superior in appearance and other properties is formed, without causing popping in the formed film during its baking.

12 Claims, 4 Drawing Sheets

METHOD FOR FORMATION OF TWO-LAYER COATING FILM BY APPLICATION OF TWO COATINGS IN STATE OF TWO LAYERS CONTACTED WITH EACH OTHER

BACKGROUND OF THE INVENTION

The present invention relates to a method for forming a two-layer coating film superior in appearance and other properties by applying two coatings in a state of two layers contacted with each other by the use of a die coater capable of discharging two coatings in a state of two layers contacted with each other.

In the field of coil coating, there has widely been employed a so-called two-coat two-bake method which comprises (1) roll-coating a metal plate with a primer, followed by baking, to impart corrosion resistance, etc. to the metal plate, (2) winding up the primer-applied metal plate in a coil shape, and (3) roll-coating the plate with a top coating, followed by baking, to impart good appearance, etc. to the plate.

In the two-coat two-bake method, however, many operational steps (two times of coating and two times of baking) are required; therefore, simplification of steps has been sought. To respond to this demand, a method was proposed which uses a die capable of discharging two coatings in a state of two layers contacted with each other (the method is hereinafter referred to as "die-coating method" in some cases) [see Japanese Patent Application Kokai (Laid-Open) No. 100570/1992].

In forming a coating film by the die-coating method, however, there are problems such as (a) deterioration in appearance and other properties, caused by the mixing of primer film and top coating film and (b) occurrence of foaming (popping) in formed film during its baking. Therefore, the die-coating method has not been put into practical application.

BRIEF SUMMARY OF THE INVENTION

Hence, the present inventors made an intensive study with an aim of establishing a method capable of forming a cured two-layer coating film superior in appearance and other properties by the use of the die-coating method without causing foaming (popping), etc. during baking of formed film. As a result, the present inventors found out that the above aim could be achieved by applying two coatings each having particular properties, in a state of two layers (upper and lower layers) contacted with each other. The present invention has been completed based on the finding.

The present invention provides a method for forming a two-layer coating film by applying, onto a material to be coated, two coatings in a state of two layers contacted with each other, by the use of a die capable of discharging two coatings in a state of two layers contacted with each other and then conducting baking, wherein (a) the lower-layer coating discharged from the die of the coater has a viscosity of 70 seconds or more as measured at 25° C. by the use of Ford Cup No. 4, and (b) the temperature at which the oscillatory period of pendulum begins to decrease owing to the curing of the upper-layer coating, is higher than the temperature at which the oscillatory period of pendulum begins to decrease owing to the curing of the lower-layer coating, when the two temperatures are measured by a method using a viscoelasticity tester of free damped oscillation type [the method is hereinafter abbreviated to FDOM (free damped oscillation method)] in some cases; and/or, the temperature at which the logarithmic decrement of pendulum shows its peak owing to the curing of the upper-layer coating, is higher than the temperature at which the logarithmic decrement of pendulum shows its peak owing to the curing of the lower-layer coating, when the two temperatures are measured by FDOM.

BRIEF DESCRIPTION OF THE DRAWINGS

The method of the present invention is hereinafter described in detail by referring, as necessary, to the accompanying drawings.

DETAILED DESCRIPTION

In the method of the present invention, a two-layer coating film is formed by (1) discharging two coatings (an upper-layer coating and a lower-layer coating) in a state of two layers contacted with each other, by the use of a die coater capable of discharging the two coatings in a state of two layers contacted with each other; (2) applying the discharged coatings on a material to be coated, with the state being maintained; and then (3) conducting baking.

Figure 1:
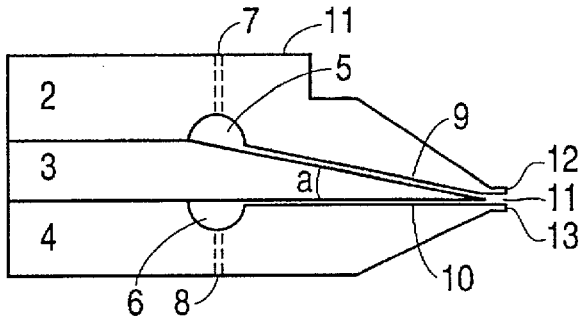
FIG. 1 is a conceptual sectional view showing an example of the die of the die coater used in the present invention.

The die coater usable in the method of the present invention includes, for example, a die coater described in Japanese Patent Application Kokai (Laid-Open) No. 100570/1992. The conceptual sectional view of a typical example of the die of the die coater is shown in FIG. 1. In FIG. 1, a die 1 is constituted by three piled blades (an upper blade 2, an intermediate blade 3 and a lower blade 4) and two side plates (not shown) provided on the both sides of the three blades. The upper blade 2 has a coating-holding portion 5 and a coating-feeding hole 7, and the lower blade 4 has a coating-holding portion 6 and a coating-feeding hole 8. The gap between the upper blade 2 and the intermediate blade 3 and the gap between the intermediate blade 3 and the lower blade 4 form slots 9 and 10, respectively. The vertical distance of each slot, i.e. the thickness of the coating passing through each slot is set in the range of generally 5–500 μm, preferably 10–120 μm so that the pressure loss of coating in slot is not too large and the coating can flow at a uniform speed throughout the entire length of slot.

The angle "a" formed by the slot 9 and the slot 10 preferably has an acute angle of generally 30° or less, preferably 5°–25° so that the upper-layer coating passing through the slot 9 and the lower-layer coating passing through the slot 10 merge smoothly to form a two-layer contacted with each other. Incidentally, the front end of the intermediate blade 3 need not be a knife edge.

The slots 9 and 10 are preferably formed so as to merge inside the die to become a single slot 11, as shown in FIG. 1, but may be formed so as to have individual outlets. Incidentally, to the die 1 are fitted a mechanism capable of supporting the die 1 and moreover capable of adjusting the positions of the lips 12 and 13 of the die; a mechanism for feeding coatings quantitatively to the die; and so forth (these mechanisms are not shown in FIG. 1).

Figure 2:
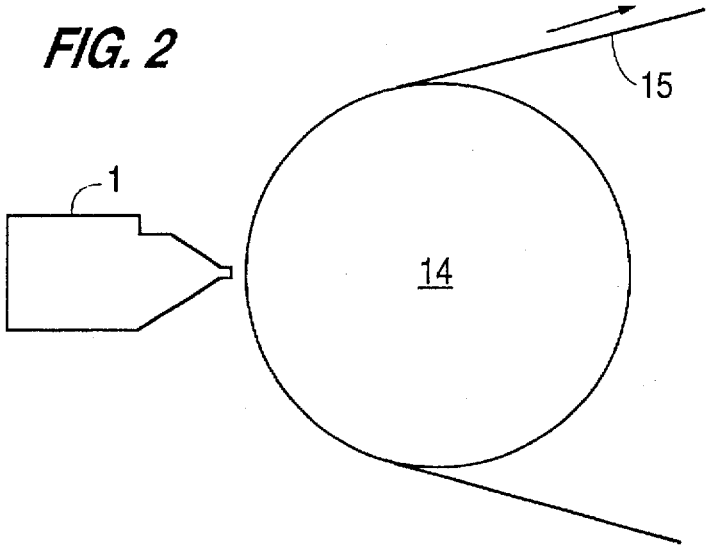
FIG. 2 is a drawing showing an example of the relative positions taken by the die of die coater and a material to be coated, when two coatings are applied in a state of two layers contacted with each other according to the method of the present invention.

In the present method, the coatings discharged from the die may be directly coated on a material to be coated, or may be once received by a rotating roll and then coated on a material to be coated, from the rotating roll. FIG. 2 shows an example of an apparatus used when the coatings discharged from a die are directly coated on a material to be coated. In this apparatus, a material 15 to be coated is supported by a supporting roll 14, and the slit of a die is provided perpendicularly to the material 15 to be coated, i.e. so as to face the center of the supporting roll 14.

In applying coatings using the apparatus of FIG. 2, while the material 15 to be coated is being run in the direction of an arrow mark, a lower-layer coating and an upper-layer coating are fed to the die from the coating inlet 8 and the coating inlet 7, respectively, in respective amounts to be coated, by the use of metering pumps. The coatings are fed into the coating-holding portions 5 and 6, pass through the slots 9 and 10, merge in the slot 11 in a state of two-layers contacted with each other, and are discharged in that state. The coatings discharged in a state of two-layers contacted with each other are adhered uniformly onto the material 15 to be coated, with the state being maintained, whereby a coating film having a desired thickness is formed.

The material to be coated includes, for example, metal plates such as steel plate, galvanized steel plate, aluminum-plated steel plate, tin-plated steel plate, alloy-plated steel plate (e.g. steel plates plated with zinc-aluminum alloy, zinc-nickel alloy or iron-zinc alloy), copper plate and the like; chemically treated metal plates obtained by subjecting one of the above plates to a chemical conversion treatment such as chromate treatment, phosphoric acid salt treatment, composite oxide film treatment or the like; metal plates obtained by forming a primer film on one of the above metal plates and the above chemically treated metal plates; plastics; wood; and so forth.

The combination of the lower-layer coating and the upper-layer coating discharged from the die coater can be, for example, a combination of primer-top coating, primer-intermediate coating, intermediate coating-top coating, or top coating base-top coating clear.

In the present method, the lower-layer coating discharged from the die coater, must have a viscosity as measured at 25° C. by the use of Ford Cup No. 4 (the viscosity is hereinafter referred to as "Ford Cup viscosity" in some cases), of 70 seconds or more. The viscosity is preferably 90 seconds or more, more preferably 100–140 seconds. When the lower-layer coating has a Ford Cup viscosity of less than 70 seconds, the lower-layer coating discharged from the die is mixed with the upper-layer coating, whereby the state of two-layers contacted with each other is disrupted and the appearance and other properties of film formed are deteriorated.

Meanwhile, the viscosity of the upper-layer coating may be lower or higher than, or the same as the viscosity of the lower-layer coating; however, it is generally preferable that the former viscosity is higher than the latter viscosity. The upper-layer coating can have a Ford Cup viscosity of generally 100 seconds or more, preferably 120 seconds or more, more preferably 130–300 seconds.

The viscosities of the lower-layer coating and the upper-layer coating can be adjusted by, for example, changing the proportion of the used solvent to the used vehicle resin.

In the present method, the kinds of the lower-layer coating and the upper-layer coating can be appropriately selected depending upon the functions to be possessed by them, and have no particular restrictions. When the lower-layer coating is, for example, a primer, there can be used coatings ordinarily used as a primer in the coating industry. Preferable examples of them are coatings using, as the base resin, an epoxy resin, an acrylic resin, a vinyl resin, a polyamine resin, an alkyd resin, a polyester resin or the like; and particularly preferable examples are coatings using, as the base resin, an epoxy resin or a polyester resin. When the upper-layer coating is, for example, a top coating, there can be used coatings ordinarily used as a top coating in the coating industry. Preferable examples of them are coatings using, as the base resin, an acrylic resin, an alkyd resin, a polyester resin, a silicone resin, a silicone-modified polyester resin, a fluoro-resin, a urethane resin, a vinyl chloride resin or the like; and particularly preferable examples are coatings using a polyester resin as the base resin.

The lower-layer coating and the upper-layer coating generally contain a solvent besides the base resin. They may further contain, as necessary, curing agents such as amino resin, polyisocyanate compound and the like; pigments such as coloring pigment, rust-preventive pigment, extender pigment and the like; and coating additives such as film surface-modifying agent, antifoaming agent, curing catalyst and the like.

In the present method, two coatings (the upper-layer coating and the lower-layer coating) are applied on a material to be coated, in a state of two layers contacted with each other and then baking is conducted. The film thicknesses of the lower-layer coating and the upper-layer coating can be appropriately selected depending upon the functions required for the individual films. When the lower-layer coating and the upper-layer coating are a primer and a top coating, respectively, and applied in coil coating, it is generally preferable that the lower coating film has an as-dried thickness of about 2–10 μm and the upper coating film has an as-dried thickness of about 8–25 μm. Baking is conducted under such conditions (temperature, time, etc.) as the two coating layers can be cured, and the conditions can be appropriately set depending upon the kinds of the two coating layers, etc. Generally, heating in baking brings about viscosity change of film owing to two factors, i.e (1) viscosity increase resulting from the vaporization of solvent in coating film and resultant increase in solid content in film and (2) viscosity decrease resulting form temperature rise; then, the film reaches a curing-start temperature and curing starts.

In the present invention, it was found out that in order to prevent the occurrence of popping in coating film during the baking of the film, the lower-layer coating and the upper-layer coating must satisfy at least either, preferably both of the following requirements (1) and (2) when tested by the method (FDOM) using a viscoelasticity tester of free damped oscillation type.

(1) The temperature at which the oscillatory period of pendulum begins to decrease owing to the curing of the upper-layer coating, is higher than the temperature at which the oscillatory period of pendulum begins to decrease owing to the curing of the lower-layer coating.

(2) The temperature at which the logarithmic decrement of pendulum shows its peak owing to the curing of the upper-layer coating, is higher than the temperature at which the logarithmic decrement of pendulum shows its peak owing to the curing of the lower-layer coating.

The temperature at which the oscillatory period of pendulum begins to decrease owing to the curing of the upper- or lower-layer coating, mentioned in the above (1) corresponds roughly to the temperature at which the coating begins curing. The temperature at which the logarithmic decrement of pendulum shows its peak owing to the curing of the upper- or lower-layer coating, mentioned in the above (2) corresponds roughly to the temperature at which the coating completes curing.

When the requirement (1) is satisfied, the start of curing of the upper-layer coating film is later than that of the lower-layer coating film; therefore, the volatile substances generated from the lower-layer coating film by its vaporization, decomposition, etc. can easily pass through the upper-layer coating film by the start of curing of the upper-layer coating film; thereby, occurrence of popping can be prevented. When the requirement (2) is satisfied, the curing of the lower-layer coating film proceeds earlier than the curing of the upper-layer coating film; the volatile substances generated from the lower-layer coating film during the curing can easily pass through the upper-layer coating film which is not yet cured satisfactory; the upper-layer coating film can keep fluidity and smoothness even after the completion of generation of volatile substances from the lower-layer coating film; thereby, occurrence of popping can be prevented.

Figure 3:
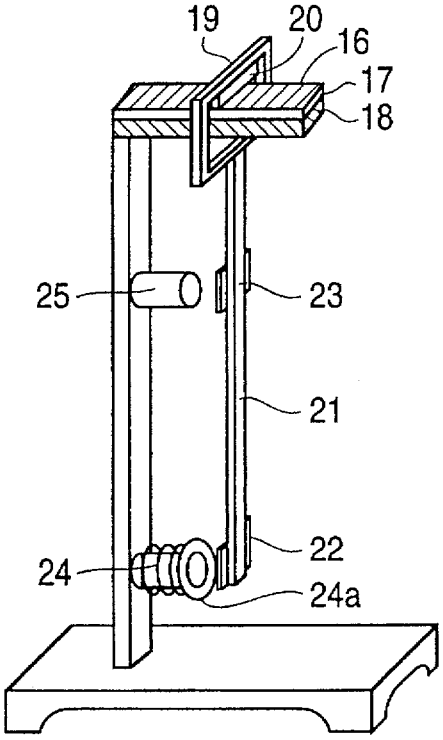
FIG. 3 is a schematic drawing showing the key parts of the viscoelasticity tester of free damped oscillation type used in the viscoelasticity measurement (FDOM) according to the present invention.

In the present invention, measurement of "oscillatory period" and "logarithmic decrement" by viscoelasticity tester of free damped oscillation type can be made using a viscoelasticity tester for coating which is disclosed in Japanese Utility Model Application Kokai (Laid-Open) No. 56757/1994. The schematic perspective view of the tester is shown in FIG. 3.

The viscoelasticity tester comprises a metal substrate 17 on which a sample coating is applied; a hot plate 18 for heating the sample coating, provided beneath the metal substrate; a thermometer (not shown) for measurement of the temperature of the sample coating; a rigid material-made pendulum 19 of pyramid edge type, comprising a pyramid edge portion 20 having an edge functioning as a furclum of oscillation and a leg portion 21 having a pendulum displacement-indicating portion 23 and a to-be-attracted portion 22; a non-contact type displacement tester 25 for detection of the amplitude of pendulum; a magnetic oscillator 24 provided so as to face the to-be-attracted portion of pendulum; a temperature indicator and controller (not shown) for controlling the temperature of the hot plate 18; and a data-processing device (not shown) for computing the obtained data by the use of a personal computer to output the oscillatory period and logarithmic decrement for the sample coating and the temperature of the plate, in the form of a graph. In conducting measurement with this viscoelasticity tester, the pendulum 19 is provided so that its edge makes a vertical contact with the surface of the sample coated; simultaneously with the start of the heating of the hot plate 18, the pendulum is allowed to start free damped oscillation by momentarily adding an external force to the leg of the pendulum by way of the magnetic force of the magnetic oscillator 24; and the changes with time of the oscillatory period and logarithmic decrement of pendulum, occurring owing to the curing of the sample are measured and recorded; thereby, the temperature at which the oscillatory period of pendulum begins to decrease and the temperature at which the logarithmic decrement of pendulum shows its peak, can be determined.

Figure 4:
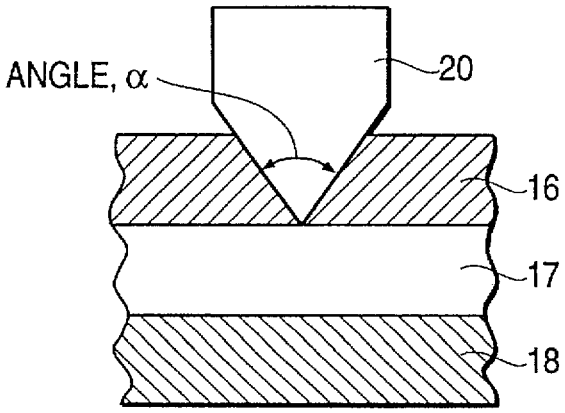
FIG. 4 is a schematic drawing showing the condition in which a pyramid-shaped edge is fitted to the viscoelasticity tester of free damped oscillation type used in the viscoelasticity measurement (FDOM) according to the present invention.

In the present invention, "the temperature at which the oscillatory period of pendulum begins to decrease" and "the temperature at which the logarithmic decrement of pendulum shows its peak" are values obtained as follows using the above-mentioned viscoelasticity tester. That is, in FIG. 4, on the surface of the sample coated on the metal substrate mounted on the hot plate is vertically placed the edge portion of the rigid material-made pendulum of pyramid edge type whose edge angle $\alpha$ is 89°, whose weight is 10 g, whose gravity center is at the center of the entire length ranging from the top end and the bottom end and whose to-be-attracted portion is made of a metal containing nickel-cobalt; the pendulum is oscillated by the magnetic oscillator with an attraction time of 1 second; the hot plate is heated at a temperature elevation rate of 10° C./min; and there are measured, by the use of the non-contact type displacement tester, the changes with time of the oscillatory period and logarithmic decrement of pendulum occurring owing to the curing of the sample coating. In the temperature-oscillatory period graph obtained, "the temperature at which the oscillatory period of pendulum begins to decrease owing to the curing of the coating" is a temperature at the inflection point where the oscillatory period decreases suddenly owing to the curing of the sample.

The above-mentioned requirement (1) regarding the temperature at which the oscillatory period of pendulum begins to decrease owing to the curing of coating, can be satisfied, for example, by using a lower-layer coating whose curing temperature is lower than that of the upper-layer coating. The temperature at which the oscillatory period of pendulum begins to decrease owing to the curing of lower-layer coating, can be generally about 60°–150° C., preferably about 80°–140° C. The temperature at which the oscillatory period of pendulum begins to decrease owing to the curing of upper-layer coating, is desirably higher than the temperature at which the oscillatory period of pendulum begins to decrease owing to the curing of lower-layer coating, by generally at least 5° C., particularly 10°–50° C.

To satisfy the above-mentioned requirement (2) regarding the temperature at which the logarithmic decrement of pendulum shows its peak owing to the curing of coating, it is necessary that the increase in apparent molecular weight caused by intertwinement of molecules during crosslinking owing to the curing of lower-layer coating and the subsequent release of molecular intertwinement caused by stress relaxation by heat take place at lower temperatures than in the upper-layer coating. To achieve that, it is necessary to use a lower-layer coating whose curing is completed at a lower temperature than the curing of the upper-layer coating. The temperature at which the logarithmic decrement of pendulum shows its peak owing to the curing of the lower-layer coating, can be generally about 100°–160° C., preferably about 120°–150° C. The temperature at which the logarithmic decrement of pendulum shows its peak owing to the curing of the upper-layer coating, is desirably higher than the temperature at which the logarithmic decrement of pendulum shows its peak owing to the curing of the lower-layer coating, by at least 5° C., particularly 10°–70° C.

The curing or crosslinking reactions of the lower-layer coating and the upper-layer coating can be controlled by appropriately selecting the kind and content of the functional group possessed by the base resin used in each coating, the kind of the crosslinking agent used in each coating, the kind and amount of the curing catalyst used in each coating, etc. For example, by using, in the lower-layer coating, a base resin-crosslinking agent combination which can give rise to a crosslinking reaction at a temperature lower than in the upper-layer coating, or by adding, to the lower-layer coating, a curing catalyst capable of promoting the crosslinking reaction, there can be provided a lower-layer coating/upper-layer coating combination which satisfies the above requirement (1) and/or (2).

The crosslinking agent usable includes those which can give rise to a crosslinking reaction at relatively low temperatures, such as amino resin, blocked polyisocyanate compound and the like.

The amino resin includes, for example, methylolamino resins obtained by reacting an amino component (e.g. melamine, urea, benzoguanamine, acetoguanamine, steroguanamine, spiroguanamine and dicyandiamide) with an aldehyde. The aldehyde used in the above reaction includes, for example, formaldehyde, paraformaldehyde, acetaldehyde and benzaldehyde. As the amino resin, there can also be used compounds obtained by etherifying the above methylolamino resin with an appropriate alcohol. Examples of the alcohol used in the etherification are methyl alcohol, ethyl alcohol, n-propyl alcohol, isopropyl alcohol, n-butyl alcohol, isobutyl alcohol, 2-ethylbutanol and 2-ethylhexanol.

The blocked polyisocyanate compound is a compound obtained by blocking the free isocyanate group of a polyisocyanate compound with a blocking agent. The polyisocyanate compound includes, for example, aliphatic diisocyanates such as hexamethylene diisocyanate, trimethylhexamethylene diisocyanate and the like; alicyclic diisocyanates such as hydrogenated xylylene diisocyanate, isophorone diisocyanate and the like; aromatic diisocyanates such as tolylene diisocyanate, 4,4'-diphenylmethane diisocyanate and the like; organic polyisocyanates, for example, polyisocyanates having three or more isocyanate groups, such as triphenylmethane-4,4',4"-triisocyanate, 1,3,5-triisocyanatobenzene, 2,4,6-triisocyanatotoluene, 4,4'-dimethyldiphenylmethane-2,2',5,5'-tetraisocyanate and the like; adducts between the above organic polyisocyanate and polyhydric alcohol, low-molecular polyester resin, water or the like; cyclic polymers between the above organic polyisocyanates; and isocyanate-biuret derivatives.

As the blocking agent used for blocking the free isocyanate group, there can be preferably used, for example, phenol types such as phenol, cresol, xylelnol and the like; lactam types such as ε-caprolactam, δ-valerolactam, γ-butyrolactam, β-propiolactam and the like; alcohol types such as methanol, ethanol, n- or iso-propyl alcohol, n-, iso- or tert-butyl alcohol, ethylene glycol monomethyl ether, ethylene glycol monoethyl ether, ethylene glycol monobutyl ether, diethylene glycol monomethyl ether, diethylene glycol monoethyl ether, propylene glycol monomethyl ether, benzyl alcohol and the like; oxime types such as formamidoxime, acetaldoxime, acetoxime, methyl ethyl ketoxime, diacetyl monoxime, benzophenone oxime, cyclohexane oxime and the like; and active methylene types such as dimethyl malonate, diethyl malonate, ethyl acetoacetate, methyl acetoacetate, acetylacetone and the like.

By mixing the above-mentioned polyisocyanate compound and the above-mentioned blocking agent, the free isocyanate group of the polyisocyanate compound can be blocked easily.

The curing catalyst used when the crosslinking agent is an amino resin, includes, for example, strong acids and neutralization products thereof. Typical examples thereof are sulfonic acid compounds (strong acids) such as p-toluenesulfonic acid, dodecylbenzenesulfonic acid, dinonylnaphthalenesulfonic acid, dinonylnaphthalenedisulfonic acid and the like; and neutralization products thereof with amines.

The curing catalyst used when the crosslinking agent is a blocked polyisocyanate compound, includes curing catalysts capable of promoting the dissociation of the blocked polyisocyanate compound (curing agent), for example, organic metal catalysts such as tin octylate, dibutyltin di(2-ethylhexanonate), dioctyltin di(2-ethylhexanoate), dibutyltin dilaurate, dibutyltin oxide, dioctyltin oxide, lead 2-ethylhexanoate and the like.

The present invention is hereinafter described more specifically by way of Examples.

EXAMPLE 1

There were used a die coater capable of discharging two coatings in a state of two layers contacted with each other; as an upper-layer coating, KP Color No. 1580 White [hereinafter abbreviated to KP 1580 (see Note 1)] whose viscosity was adjusted to 140 seconds as measured at 25° C. by Ford Cup No. 4; and, as a lower-layer coating, KP Color No. 8405 Primer [hereinafter abbreviated to KP 8405 (see Note 2)] whose viscosity was adjusted to 100 seconds as measured at 25° C. by Ford Cup No. 4.

Note 1: KP 1580 is a white top coating of polyester-melamine resin type for precoated metal, produced by Kansai Paint Co., Ltd. It is composed of a polyester resin having a number-average molecular weight of about 2,500 and a hydroxyl value of about 90 mg KOH/g and a methyl-etherified melamine resin, and contains an acid catalyst as a curing catalyst.

Note 2: KP 8405 is a modified epoxy-urethane resin type primer produced by Kansai Paint Co., Ltd. It is composed of a modified epoxy resin having a number-average molecular weight of 3,000 and a blocked isocyanate as a crosslinking agent.

The upper-layer coating and the lower-layer coating were discharged in a state of two layers contacted with each other so that the as-dried film thickness of the upper-layer coating became 18 μm and the as-dried film thickness of the lower-layer coating became 4 μm and, as shown in FIG. 2, were coated on a hot-dip-galvanized steel plate (treated with zinc phosphate) running continuously. Then, baking was conducted for 60 seconds under such a temperature condition that the maximum temperature of the steel plate became 220° C., whereby a coated plate was obtained. The coated plate had good appearance and showed good film properties in hardness, processability, adhesivity to steel plate, etc.

Figure 5:
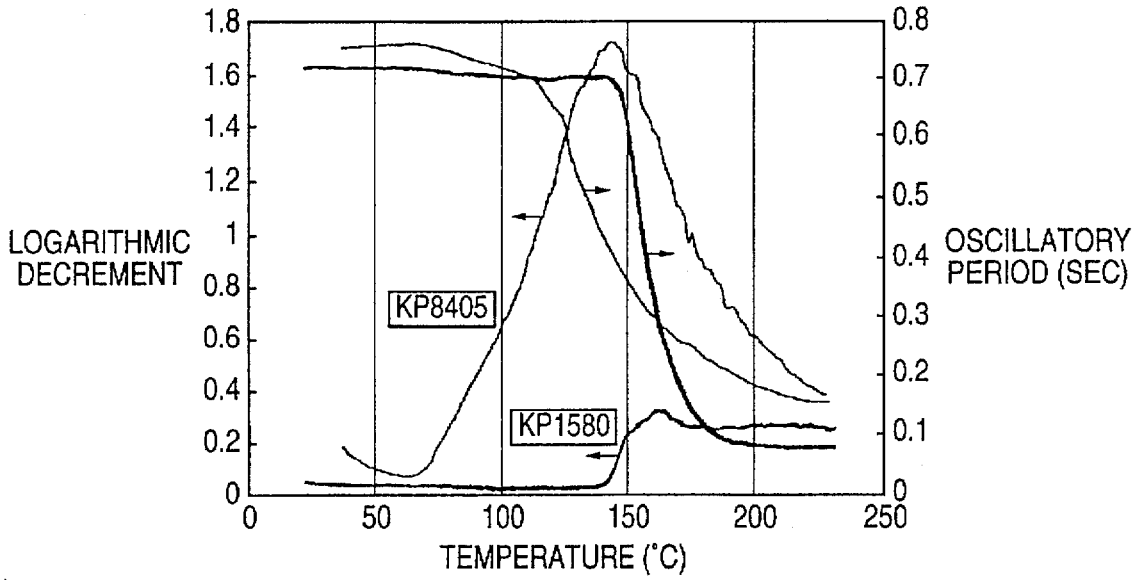
FIG. 5 is a graph showing (1) the relation of logarithmic decrement and temperature and (2) the relation of oscillatory period and temperature, both measured by FDOM on the upper-layer coating KP 1580 or the lower-layer coating KP 8405 each used in Example 1 described later.

The relation of oscillatory period and temperature and the relation of logarithmic decrement and temperature, of each of KP 1580 and KP 8405 as measured by FDOM are shown in FIG. 5.

EXAMPLE 2

An operation was conducted in the same manner as in Example 1 except that there were used, as an upper-layer coating, KP 1580 whose viscosity was adjusted to 120 seconds as measured at 25° C. by the use of Ford Cup No. 4 and, as a lower-layer coating, KP Color No. 8472 Primer [hereinafter abbreviated to KP 8472 (see Note 3)] whose viscosity was adjusted to 100 seconds as measured at 25° C. by the use of Ford Cup No. 4, whereby a coated plate was obtained.

Note 3: KP 8472 is an epoxy-urea rein type primer produced by Kansai Paint Co., Ltd. and contains an epoxy resin having a number-average molecular weight of about 5,500.

The coated plate had good appearance and showed good film properties in hardness, processability, adhesivity to steel plate, etc.

Figure 6:
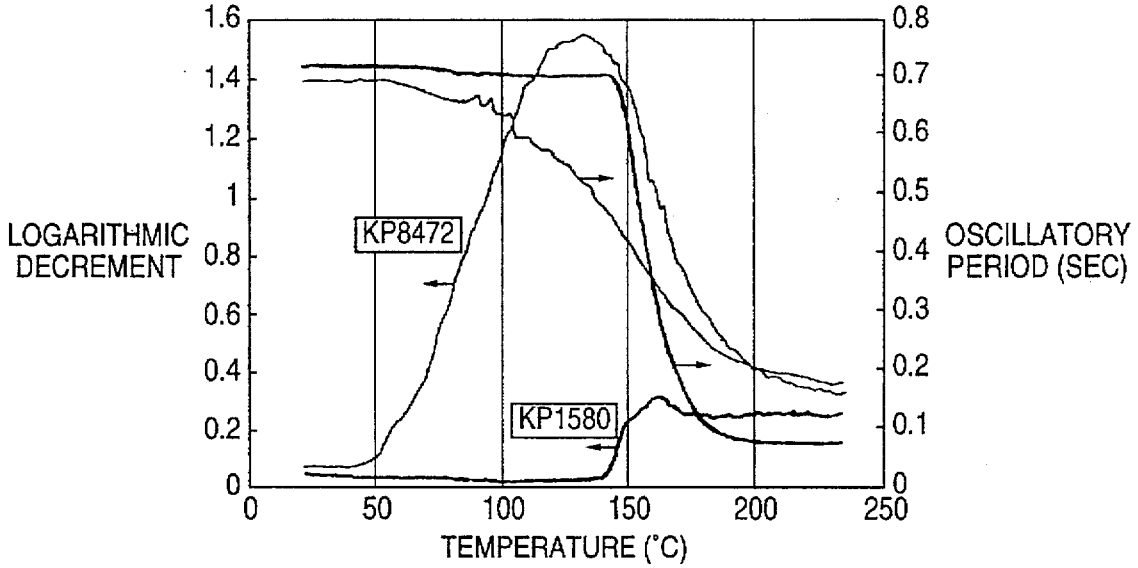
FIG. 6 is a graph showing (1) the relation of logarithmic decrement and temperature and (2) the relation of oscillatory period and temperature, both measured by FDOM on the upper-layer coating KP 1580 or the lower-layer coating KP 8472 each used in Example 2 described later.

The relation of oscillatory period and temperature and the relation of logarithmic decrement and temperature, of each of KP 1580 and KP 8472 as measured by FDOM are shown in FIG. 6.

EXAMPLE 3

An operation was conducted in the same manner as in Example 1 except that there were used, as an upper-layer coating, KP Color No. 1510 White [hereinafter abbreviated to KP 1510 (see Note 4)] whose viscosity was adjusted to 140 seconds as measured at 25° C. by the use of Ford Cup No. 4 and, as a lower-layer coating, KP Color No. 8608 Primer [hereinafter abbreviated to KP 8608 (see Note 5)] whose viscosity was adjusted to 90 seconds as measured at 25° C. by the use of Ford Cup No. 4, whereby a coated plate was obtained.

Note 4: KP 1510 is a white top coating of polyester-melamine resin type for precoated metal, produced by Kansai Paint Co., Ltd. It is composed of a polyester resin having a number-average molecular weight of about 5,000 and a hydroxyl value of about 20 mg KOH/g and a methyl-etherified melamine resin and contains an acid catalyst as a curing catalyst.

Note 5: KP 8608 is a polyester-melamine resin type primer, produced by Kansai Paint Co. Ltd. It is composed of a polyester resin having a number-average molecular weight of about 8,000 and a hydroxyl value of about 15 mg KOH/g and a methyl-etherified melamine resin.

The coated plate had good appearance and showed good film properties in hardness, processability, adhesivity to steel plate, etc.

Figure 7:
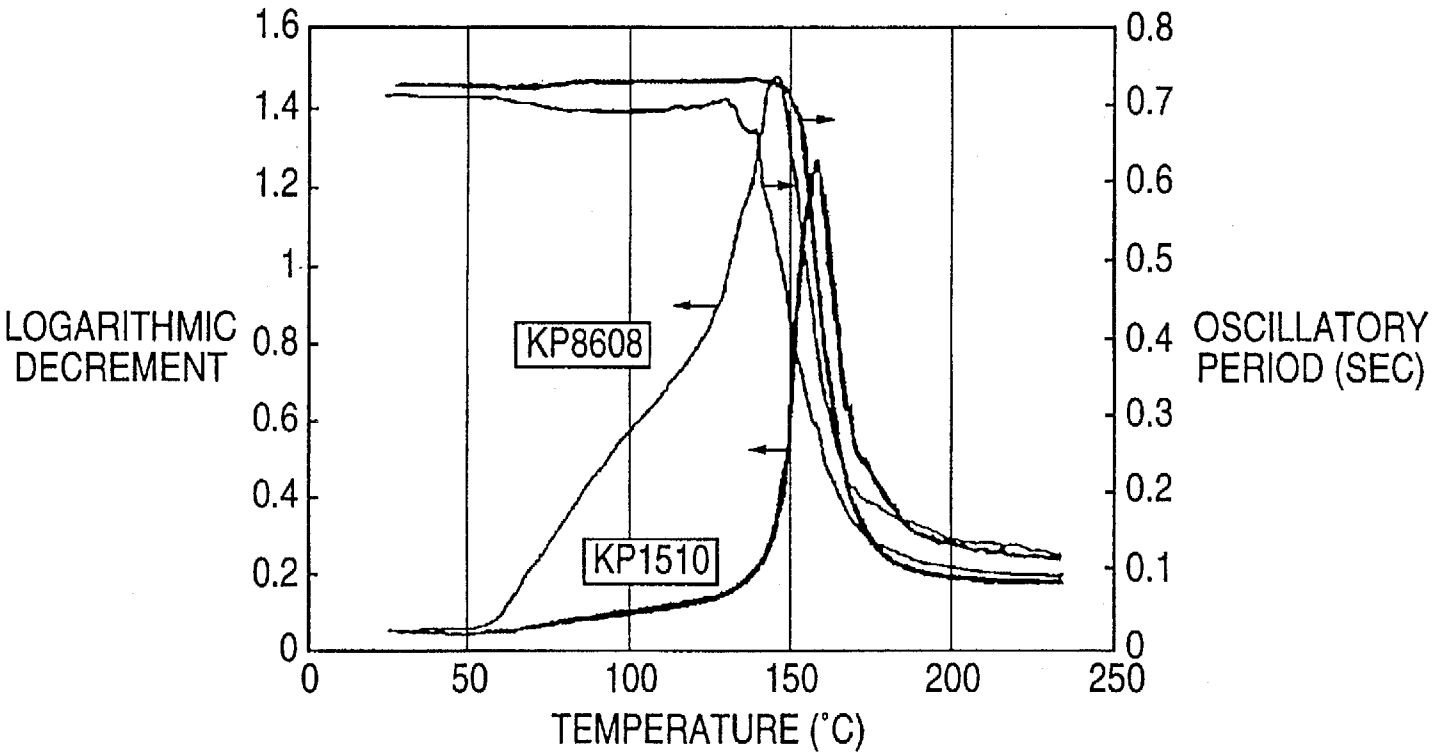
FIG. 7 is a graph showing (1) the relation of logarithmic decrement and temperature and (2) the relation of oscillatory period and temperature, both measured by FDOM on the upper-layer coating KP 1510 or the lower-layer coating KP 8608 each used in Example 3 described later.

The relation of oscillatory period and temperature and the relation of logarithmic decrement and temperature, of each of KP 1510 and KP 8608 as measured by FDOM are shown in FIG. 7.

COMPARATIVE EXAMPLE 1

An operation was conducted in the same manner as in Example 1 except that there were used, as an upper-layer coating, KP 1510 whose viscosity was adjusted to 140 seconds as measured at 25° C. by the use of Ford Cup No. 4 and, as a lower-layer coating, KP Color No. 8691 Primer [hereinafter abbreviated to KP 8691 (see Note 6)] whose viscosity was adjusted to 100 seconds as measured at 25° C. by the use of Ford Cup No. 4, whereby a coated plate was obtained.

Note 6: KP 8691 is a polyester-modified epoxy-melamine resin type primer, produced by Kansai Paint Co., Ltd. It is composed of a polyester-modified epoxy resin having a number-average molecular weight of about 10,000 and a hydroxyl value of about 10 mg KOH/g and a methyl-etherified melamine resin and contains an acid catalyst as a curing catalyst.

The coated plate showed severe foaming (popping) at the surface of the coating film.

Figure 8:
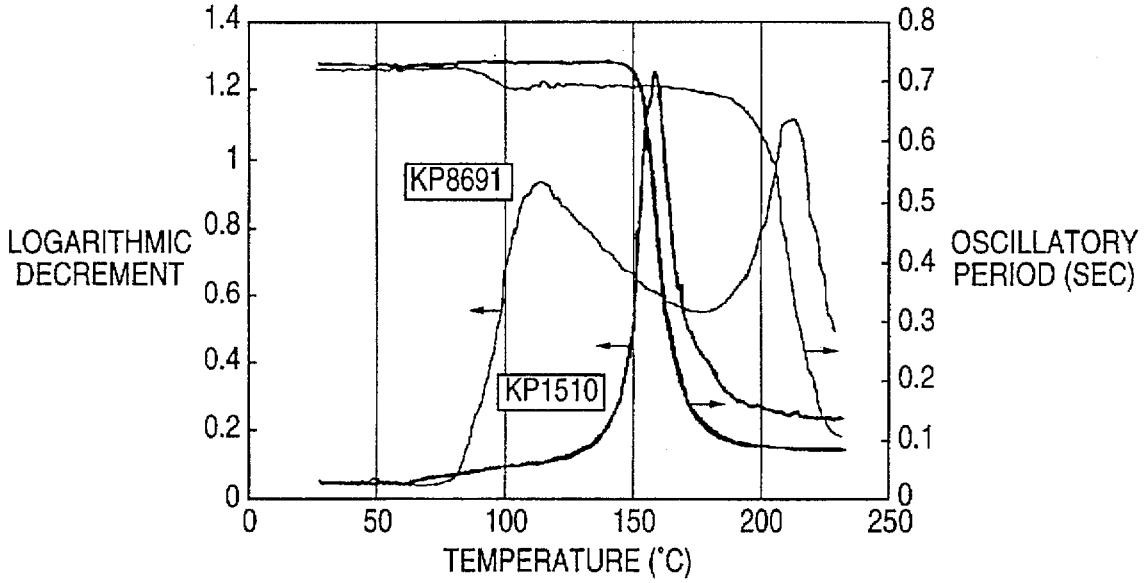
FIG. 8 is a graph showing (1) the relation of logarithmic decrement and temperature and (2) the relation of oscillatory period and temperature, both measured by FDOM on the upper-layer coating KP 1510 or the lower-layer coating KP 8691 each used in Comparative Example 1 described later.

The relation of oscillatory period and temperature and the relation of logarithmic decrement and temperature, of each of KP 1510 and KP 8691 as measured by FDOM are shown in FIG. 8.

COMPARATIVE EXAMPLE 2

An operation was conducted in the same manner as in Example 1 except that there were used, as an upper-layer coating, KP Color No. 1573 White [hereinafter abbreviated to KP 1573 (see Note 7)] whose viscosity was adjusted to 140 seconds as measured at 25° C. by the use of Ford Cup No. 4 and, as a lower-layer coating, KP Color No. 8500 Primer [hereinafter abbreviated to KP 8500 (see Note 8)] whose viscosity was adjusted to 100 seconds as measured at 25° C. by the use of Ford Cup No. 4, whereby a coated plate was obtained.

Note 7: KP 1573 is a white top coating of polyester-melamine resin type for precoated metal, produced by Kansai Paint Co., Ltd. It is composed of a polyester resin having a number-average molecular weight of about 5,000 and a hydroxyl value of about 60 mg KOH/g and a methyl-etherified melamine resin and contains an acid catalyst as a curing catalyst.

Note 8: KP 8500 is an epoxy-melamine resin type primer and is composed of an epoxy resin having a number-average molecular weight of about 2,900 and a methyl-etherified melamine resin.

The coated plate showed severe foaming (popping) at the surface of the coating film.

Figure 9:
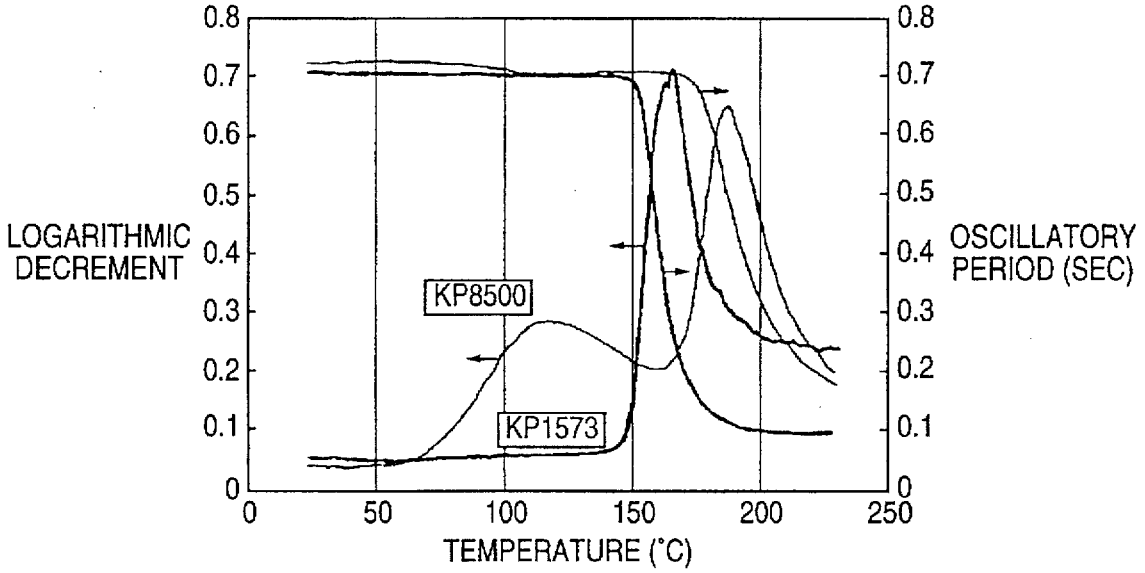
FIG. 9 is a graph showing (1) the relation of logarithmic decrement and temperature and (2) the relation of oscillatory period and temperature, both measured by FDOM on the upper-layer coating KP 1573 or the lower-layer coating KP 8500 each used in Comparative Example 2 described later.

The relation of oscillatory period and temperature and the relation of logarithmic decrement and temperature, of each of KP 1573 and KP 8500 as measured by FDOM are shown in FIG. 9.

In FIGS. 5 to 9 each showing the relation of oscillatory period and temperature and the relation of logarithmic decrement and temperature both of coating, thick lines represent upper-layer coatings and thin lines represent lower-layer coatings.

COMPARATIVE EXAMPLE 3

An operation was conducted in the same manner as in Example 1 except that there were used, as an upper-layer coating, KP 1580 whose viscosity was adjusted to 140 seconds as measured at 25° C. by the use of Ford Cup No. 4 and, as a lower-layer coating, KP 8405 whose viscosity was adjusted to 60 seconds as measured at 25° C. by the use of Ford Cup No. 4, whereby a coated plate was obtained.

The coated plate had the oozing-out of primer at the surface of top coating film and showed poor film appearance.

The upper-layer coating and lower-layer coating used in each of Examples 1–3 and Comparative Examples 1–2 were determined for the temperature at which the oscillatory period of pendulum began to decrease owing to the curing of each coating and the temperature at which the logarithmic decrement of pendulum showed its peak owing to the curing of each coating, from the respective graphs obtained by FDOM. The temperatures are shown in Table 1.

TABLE 1

| | Temperature at which oscillatroy period began to decrease | | Temperature at which logarithmic decrement showed its peak | |
|---|---|---|---|---|
| | Primer | Top coating | Primer | Top coating |
| Example 1 | 112° C. | 145° C. | 142° C. | 166° C. |
| Example 2 | 108° C. | 145° C. | 133° C. | 166° C. |
| Example 3 | 137° C. | 150° C. | 146° C. | 158° C. |
| Comparative Example 1 | 200° C. | 150° C. | 217° C. | 158° C. |
| Comparative Example 2 | 173° C. | 150° C. | 187° C. | 167° C. |

As is clear from the above-mentioned Examples and Comparative Examples, there can be formed, according to the method of the present invention employing two-layer coat one-bake by die coating, a cured two-layer coating film superior in appearance and other properties without the oozing-out of primer at the surface of upper-layer film or the generation of popping in film during baking.

Therefore, in the present method, the operational steps are simple as compared with those in the two-coat two-bake method which has generally been used in coil coating.

What is claimed is:

1. A method for forming a two-layer coating film by applying, onto a material to be coated, two coatings in a state of two layers contacting each other, by the use of a die capable of discharging two coatings in a state of two layers contacting each other and then conducting baking, to cure the two-layer coating film, wherein (a) the lower-layer coating discharged from the die of the coater, before baking, has a viscosity of 70 seconds or more as measured at 25° C. by the use of Ford Cup No. 4, and (b) a temperature at which an oscillatory period of a pendulum in a viscoelasticity tester of free damped oscillation type begins to decrease owing to curing of the upper-layer coating, is higher than a temperature at which an oscillatory period of a pendulum in the viscoelasticity tester begins to decrease owing to curing of the lower-layer coating; and/or, a temperature at which a logarithmic decrement of a pendulum shows its peak owing to the curing of the upper-layer coating, is higher than a temperature at which a logarithmic decrement of a pendulum shows its peak owing to the curing of the lower-layer coating, said temperature being the temperature measured of the coating applied on a metal substrate of the viscoelasticity tester of free damped oscillation type.

2. The method according to claim 1, wherein the temperature at which the oscillatory period of pendulum begins to decrease owing to the curing of the upper-layer coating, is higher than the temperature at which the oscillatory period of pendulum begins to decrease owing to the curing of the lower-layer coating, when the two temperatures are measured by the use of a visco-elasticity tester of free damped oscillation type; and the temperature at which the logarithmic decrement of pendulum shows its peak owing to the curing of the upper-layer coating, is higher than the temperature at which the logarithmic decrement of pendulum shows its peak owing to the curing of the lower-layer coating, when the two temperatures are measured by the use of a viscoelasticity tester of free damped oscillation type.

3. The method according to claim 1, wherein the viscosity of the lower-layer coating before baking as measured at 25° C. by Ford Cup No. 4 is 90 seconds or more.

4. The method according to claim 1, wherein a viscosity of the upper-layer coating before baking is higher than the viscosity of the lower-layer coating before baking.

5. The method according to claim 1, wherein a viscosity of the upper-layer coating as measured at 25° C. by Ford Cup No. 4 is 100 seconds or more.

6. The method according to claim 1, wherein the lower-layer coating is a primer containing an epoxy resin or a polyester resin as a base resin and the upper-layer coating is a top coating containing a polyester resin as a base resin.

7. The method according to claim 1, wherein the temperature at which the oscillatory period of pendulum begins to decrease owing to the curing of the lower-layer coating is in the range of 60°–150° C.

8. The method according to claim 1, wherein the temperature at which the oscillatory period of pendulum begins to decrease owing to the curing of the upper-layer coating is higher by at least 5° C. than the temperature at which the oscillatory period of pendulum begins to decrease owing to the curing of the lower-layer coating.

9. The method according to claim 8, wherein the temperature at which the oscillatory period of pendulum begins to decrease owing to the curing of the upper-layer coating is higher by 10°–50° C. than the temperature at which the oscillatory period of pendulum begins to decrease owing to the curing of the lower-layer coating.

10. The method according to claim 1, wherein the temperature at which the logarithmic decrement of pendulum shows its peak owing to the curing of the lower-layer coating is in the range of 100°–160° C.

11. The method according to claim 1, wherein the temperature at which the logarithmic decrement of pendulum shows its peak owing to the curing of the upper-layer coating is higher by at least 5° C. than the temperature at which the logarithmic decrement of pendulum shows its peak owing to the curing of the lower-layer coating.

12. The method according to claim 11, wherein the temperature at which the logarithmic decrement of pendulum shows its peak owing to the curing of the upper-layer coating is higher by 10°–70° C. than the temperature at which the logarithmic decrement of pendulum shows its peak owing to the curing of the lower-layer coating.

* * * * *